US007778591B1

(12) United States Patent
Van Hoff et al.

(10) Patent No.: US 7,778,591 B1
(45) Date of Patent: Aug. 17, 2010

(54) RADIO WITH BACKCHANNEL FEEDBACK

(75) Inventors: Arthur Anthonie Van Hoff, Menlo Park, CA (US); Mark Andrew Ross, San Carlos, CA (US)

(73) Assignee: Dell Products L.P., Round Rock, TX (US)

( * ) Notice: Subject to any disclaimer, the term of this patent is extended or adjusted under 35 U.S.C. 154(b) by 721 days.

(21) Appl. No.: 11/697,630

(22) Filed: Apr. 6, 2007

Related U.S. Application Data

(60) Provisional application No. 60/790,389, filed on Apr. 7, 2006.

(51) Int. Cl.
*H04H 9/00* (2006.01)

(52) U.S. Cl. ..... 455/2.01; 455/3.02; 455/3.06; 700/94

(58) Field of Classification Search ..... 455/2.01, 455/3.02, 3.03, 3.06, 66.1, 556.1, 179.1, 455/456.1, 456.3; 725/38, 61, 139, 140, 725/135, 105; 709/204; 700/94
See application file for complete search history.

(56) References Cited

U.S. PATENT DOCUMENTS 6,990,312 B1 * 1/2006 Gioscia et al. ..... 455/3.06
2002/0108125 A1 * 8/2002 Joao ..... 725/139
2003/0093806 A1 * 5/2003 Dureau et al. ..... 725/107
2006/0062179 A1 * 3/2006 Simonsson et al. ..... 370/328
2007/0010222 A1 * 1/2007 van Hoff et al. ..... 455/179.1
2007/0282874 A1 * 12/2007 Metcalfe ..... 707/101
2008/0077956 A1 * 3/2008 Morrison et al. ..... 725/38
2008/0172173 A1 * 7/2008 Chang et al. ..... 701/207

* cited by examiner

*Primary Examiner*—Tan Trinh
(74) *Attorney, Agent, or Firm*—Workman Nydegger

(57) ABSTRACT

An interactive radio system includes a broadcast radio station and an interactive radio device wherein the interactive radio device sends feedback data to the broadcaster. In various embodiments, the broadcast radio station can broadcast an enhanced radio signal that includes control data to instruct the interactive radio device on how to collect feedback data. The feedback data can be collected directly by posing input requests to a listener or indirectly by transparently monitoring the listener's activities. Feedback is provided back to the broadcaster over a backchannel by which data can be sent from a listener back to the broadcast station or another data gathering source. Backchannel routes can be provided by any of a host of communications technologies such as the Internet and/or wireless networks such as cellular networks, Bluetooth, 802.11 networks, and the like.

26 Claims, 4 Drawing Sheets

RADIO WITH BACKCHANNEL FEEDBACK

CROSS-REFERENCE TO RELATED APPLICATIONS

This application claims the benefit of U.S. Provisional Patent Application Ser. No. 60/790,389 filed Apr. 7, 2006, which application is incorporated herein by reference in its entirety.

BACKGROUND OF THE INVENTION

1. The Field of the Invention

The present invention relates generally to the fields of radio and network communications. More particularly, the present invention relates to systems and methods for providing backchannel feedback from a radio receiver to a radio signal provider.

2. The Relevant Technology

Numerous forms of live media are proliferating today. For example, satellite radio, or Digital Audio Radio Service (DARS), is the broadcast of digital audio programming via satellites directly to subscribers or users. Through satellite radio, subscribers can receive high quality, uninterrupted, digital data such as radio over many different radio channels. Digital radio content includes, for example, digital quality music, talk radio, sports, news, weather, and the like. More traditionally, terrestrial broadcast media such as FM and AM radio allow radio signals to be widely broadcast to users having FM or AM receivers.

Regardless of the type of media or content delivered over radio or satellite systems, however, each is limited in that direct feedback to the broadcaster is difficult to perform rapidly or on a wide scale basis. For example, radio stations often rely upon listeners calling the radio station to request songs or respond to disk jockey queries. Some radio stations have also recently taken to receiving feedback by email or through a website. Though rapid, obtaining this sort of feedback is limited by the number of calls that can be received and by the fact that it is user and resource intensive. It is user intensive in that a listener must take the time to call in, which reduces the number of listeners willing to provide feedback. Additionally, those listeners that do call in tend to be either repeat callers or people that form a limited type of the listener base that is not necessarily representative of the entire listener base. Further, receiving calls can be taxing on a radio station, whether in terms of manpower to receive the calls, phone lines that must be maintained, or machinery that must be maintained to automatically receive and compile calls.

Alternatively, to get feedback from a large sample of the population, radio stations typically rely upon surveys or ratings services. Though more thorough, after the fact surveys take time to be prepared, do not provide the desired rapid feedback, and do not record aspects of a listener's experience that the user may not consciously consider. As a result, whether feedback is on a per caller basis or an after the fact survey, stations cannot easily know what their listeners are thinking or how different programming is affecting their listening base.

Accordingly, what is needed are faster, more broad based systems for obtaining feedback and listener data from a large sample set of the listening population.

BRIEF SUMMARY OF THE INVENTION

The present invention overcomes the above and other problems by enabling feedback from an interactive radio device to a radio broadcast source. Initially, a radio signal is broadcast from a broadcast station to an interactive radio device via a broadcast medium. By way of example, the broadcast medium, depending on the embodiment of the invention, can be satellite radio, FM (frequency modulation) and AM (amplitude modulation) radio, DAB (Digital Audio Broadcasting), also known as digital radio or high-definition radio, HD radio, Internet radio, podcast technology, and other forms of audio transmission that enable widespread user feedback to media providers.

In some embodiments, the radio signal is an enhanced radio signal that includes control data that instructs the interactive radio device on how to collect feedback data. The feedback data can be collected directly by posing input requests to a listener or indirectly by transparently monitoring the listener's activities. Regardless of whether an enhanced radio signal is used, however, feedback is provided back to the broadcast station or another data gathering source over a backchannel. Backchannel routes can be provided by any of a host of communications technologies that currently exist or may be developed. By way of example only, such technologies may include networks such as the Internet, WANs, LANs, and/or wireless networks such as: cellular networks, WiFi, Bluetooth, 802.11 networks, and the like.

Accordingly, a first example embodiment of the invention is an interactive radio device operable to provide feedback to an audio provider. The interactive radio device generally includes: a radio receiver operable to receive and play to a user an audio stream; a feedback generation module operable to generate data indicative of a user's input, listening activities, or other activities related to the content in the audio stream; and a backchannel transmitter operable to transmit the generated data to a data collector over a backchannel. By way of example, the radio receiver may be a satellite radio receiver, a DAB receiver, an FM receiver, an AM receiver, or a Web-based audio receiver. The interactive radio device may include a user input mechanism such that the generated data can include data input by a user. In one embodiment, the feedback generating module can transparently monitor a user's activities and prepare a data signal to the broadcaster to provide data on the user's input or activities.

Another example embodiment of the invention is a system for obtaining feedback from a user listening to an audio broadcast. The system generally includes: a radio broadcast system operable to generate an audio signal and transmit it to a plurality of users; and a backchannel receiver wherein the data can be received by the system through a backchannel between the radio receiver and the system. The system can include a control data insertion module for embedding control data in the audio broadcast, whereby a radio receiver configured to detect the control data can be triggered to gather data and send the data to the system on the backchannel. The system can also include an expert engine configured to analyze feedback data regarding the user to determine user preferences and listening patterns.

A further example embodiment of the invention is a larger system for obtaining feedback from a user listening to an audio broadcast. This system generally includes: an interactive radio broadcast system and at least one interactive radio device. The interactive radio broadcast system generally includes: an audio broadcast system operable to generate an audio signal and transmit it to a plurality of users; a control data insertion module for embedding control data in the audio broadcast, whereby a radio receiver configured to detect the control data can be triggered to gather data and send the data to a data collector over the backchannel; and a data collector comprising a backchannel receiver wherein the data can be received by the data collector through a backchannel between the radio receiver and the system. An interactive radio device operable to provide feedback to an audio provider generally includes: a radio receiver operable to receive and play to a user an audio broadcast; a user input mechanism configured to enable a user to input data regarding or in response to the audio broadcast; a feedback generation module operable to generate data indicate of a user's input, listening activities, or other activities related to content in the audio data stream; and a backchannel transmitter operable to transmit the generated data to the data collector.

A further example embodiment of the invention is a method for obtaining feedback from a user listening to an audio broadcast. The method includes receiving a signal from an interactive radio broadcast system and tracking data indicative of user activity related to the content of the signal. A data set is generated including the tracked data and is transmitted over a backchannel. The received signal may include control data instructing the receiving device to track particular data.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

In the following description, numerous specific details are set forth in order to provide a thorough understanding of the present invention. It will be obvious, however, to one skilled in the art that the present invention may be practiced without these specific details. In other instances, well-known aspects of the various forms of radio and other communications systems have not been described in particular detail in order to avoid unnecessarily obscuring the present invention.

The present invention enables audio broadcasters to obtain rapid feedback on their audio content from devices or listeners receiving a radio broadcast. Various embodiments of the invention go beyond monitoring listener habits or activities to include emotional or intellectual aspects of a listener's experience by receiving the listener's direct feedback on content as the content is experienced by the user. This feedback can therefore come in the form of direct user responses or indirect monitoring of user activity. The feedback can be nearly instantaneous in the event that a backchannel is readily available for the interactive radio device, or it can be stored and transmitted when a connection to a backchannel is established.

Reference will now be made to the figures wherein like structures will be provided with like reference designations. It is understood that the drawings are diagrammatic and schematic representations of presently preferred embodiments of the invention, and are not limiting of the present invention nor are they necessarily drawn to scale.

Figure 1:
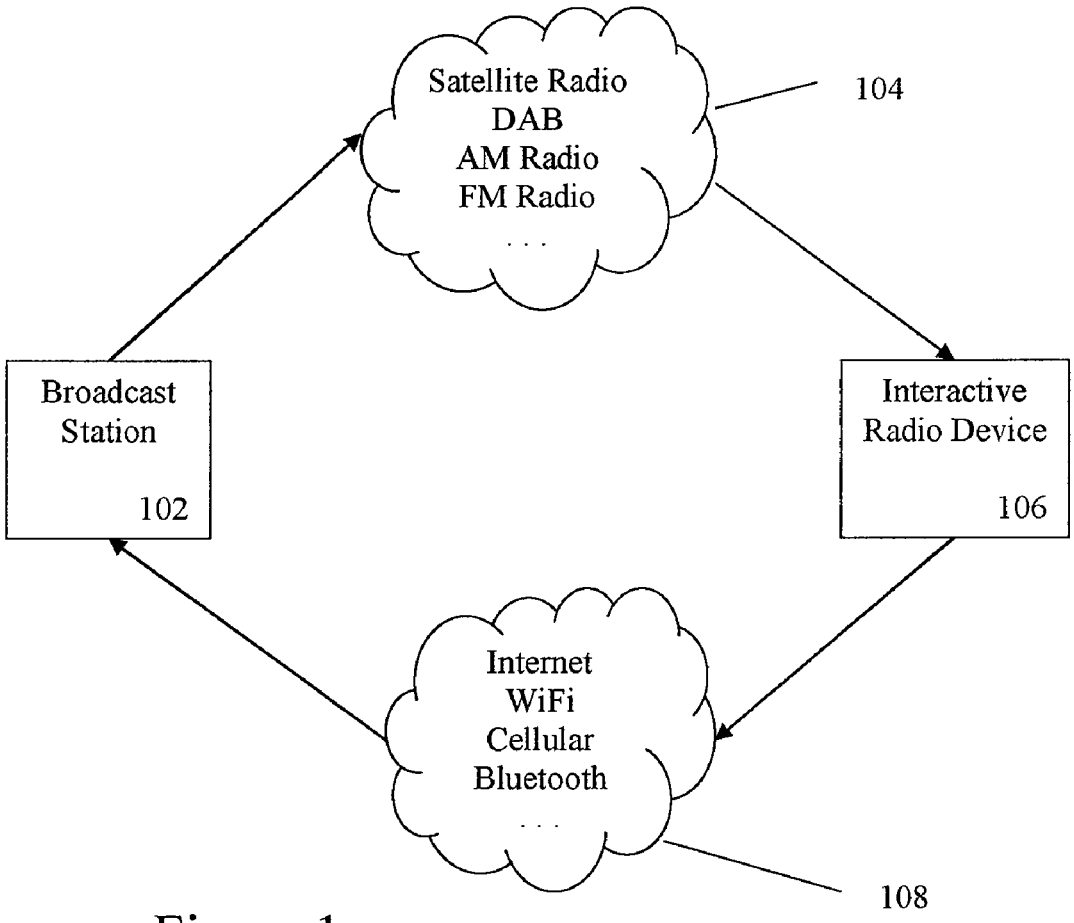
FIG. 1 illustrates an environment and system for providing feedback from an interactive radio device to a broadcast station according to one example embodiment of the invention.

With reference to FIG. 1, the invention is generally practiced as a radio signal is broadcast from a broadcast station 102 to an interactive radio device 106 via a broadcast medium 104. The broadcast medium is a system whereby a radio signal is transmitted to the interactive radio device 106. In some embodiments, the radio signal is transmitted as an enhanced radio signal that includes control data that instructs the interactive radio device 106 on how to collect feedback data. As used herein, the term "enhanced radio signal" refers to a radio signal having control data such as metadata, a URL, or other code or data that accompanies the audio signal and functions to direct an interactive radio device to obtain data from a user directly or indirectly.

By way of example, the broadcast medium 104 can be satellite radio. Generally, satellite radio is the broadcast of digital audio programming from a broadcast station 102 to satellites and from the satellites directly to the interactive radio devices that are represented by the interactive radio device 106. Through satellite radio, subscribers can receive high quality, uninterrupted, digital data such as radio over multiple radio channels. The digital data may include, for example, digital quality music, talk radio, sports, news, weather, and the like. In addition, the transmission of media content to users 106 can come through various other conventional or future broadcast mediums. For example, FM (frequency modulation) and AM (amplitude modulation) radio are the most traditional methods for providing audio content unidirectionally to a widespread audience. Another example is DAB (Digital Audio Broadcasting), also known as digital radio or high-definition radio. DAB is a growing broadcast media in which analog audio is converted into a digital signal and transmitted on an assigned channel in the AM or (more usually) FM frequency range. DAB offers higher quality audio on the FM broadcast band than analog radio transmissions. Accordingly, in view of the foregoing and other various forms of broadcast media, as used herein the term "broadcast radio" denotes any of a variety of broadcast media forms, including by way of non-limiting example AM and FM radio, satellite radio, and DAB. In addition, Internet radio, podcast technology, or other forms of Web-based media can also be used with various aspects of the invention to enable widespread user feedback to media providers using these technologies.

Because it is not currently feasible for users 106 to respond to broadcast media providers such as the broadcast station 102 via most audio broadcast systems, the present invention provides or uses backchannel routes 108 by which data can be sent from the users 106 to the broadcast station 102 or another data gathering source. Backchannel routes 108 can be provided by any of a host of communications technologies that currently exist or may be developed. Such technologies may include wired networks such as the Internet and/or wireless networks such as: cellular networks, WiFi, Bluetooth, 802.11 networks, and the like.

Figure 2:
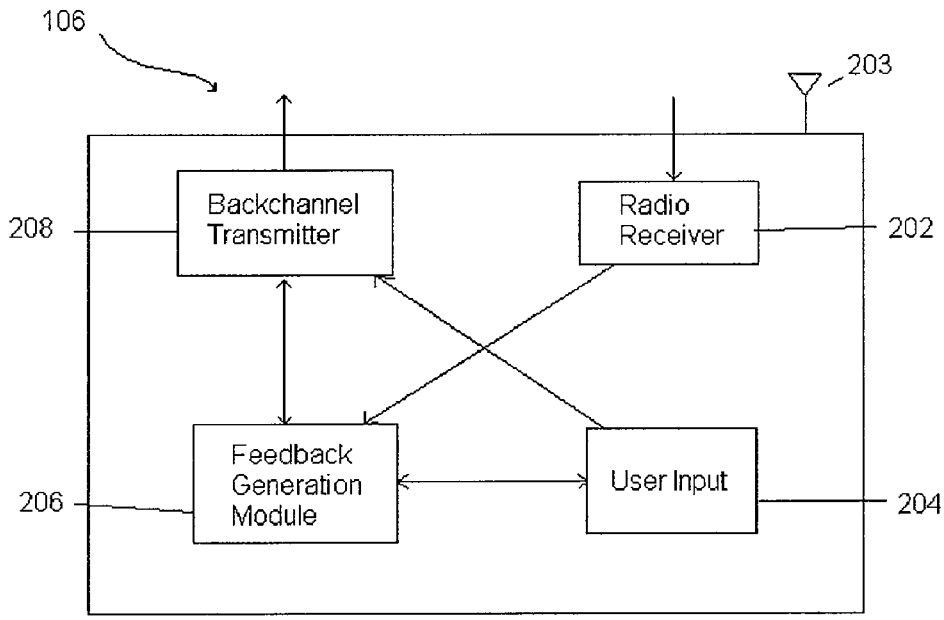
FIG. 2 illustrates a device for receiving audio content from a media provider and providing feedback over a backchannel to the media provider according to another example embodiment of the invention.

Referring now to FIG. 2, various features of an example interactive radio device 106 that can be used to provide backchannel feedback to a broadcast media provider is presented in block form. In one embodiment, the device is a single device housing numerous modules or components used in receiving a radio signal and optionally coded data, receiving user input or indirectly obtaining data about a user's activities, and generating and sending a feedback signal on a backchannel, although the modules and components can be spread across several devices or a network, if desired. The device 106 can also be multi-function and have the necessary features to serve as a Global Positioning System (GPS) unit, a digital audio player, a PDA, a cellular telephone, etc.

The portable device generally includes a radio receiver 202 with the necessary components. By way of non-limiting example, the radio receiver 202 may include an antenna 203, configured to receive an audio broadcast. The details of such components, for example those necessary to operate a satellite radio device, will be apparent to one skilled in the art in view of the disclosure herein and are not depicted to avoid unnecessarily obscuring the invention. In some embodiments of the invention, the radio receiver 202 is also configured to receive other data that is integrated with or accompanies the audio stream. Depending on the details of the system, the radio receiver can be a satellite radio receiver, an FM or AM radio receiver, a DAB receiver, and the like. The device can also have more than one receiver to obtain a variety of radio signals. Accordingly, while antenna 203 is depicted as a single antenna, those skilled in the art will recognize that multiple antennas may be used for each distinct type of radio signal.

The interactive radio device 106 also includes a user input mechanism 204 where a user can respond to direct data requests from a radio broadcaster. For example, through an appropriate form of a user input mechanism 204 the user can rate a song on a scale, respond to a talk show poll, request a song, connect to an advertiser's website, or perform other responsive activities. User input mechanisms include both conventional mechanisms such as touch pads, keyboards, buttons, voice recognition software, and the like, as well as future mechanisms.

A feedback generation module 206 in interactive radio device 106 is in communication with each of backchannel transmitter 208, radio receiver 202, and user input mechanism 204 so that it can receive data from the various features or components of the interactive radio device 106. Control data received with audio at radio receiver 202 can be processed by the feedback generation module 206 to provide a query to a user by a display (not illustrated) or audio. Alternatively, the feedback generation module 206 can be directed by the control data to run indirect diagnostics on the user's activities. The feedback generation module 206 also generates the feedback signal for transmission from backchannel transmitter 208 on a backchannel to a data collection source, for example the broadcast locale.

In another embodiment of the invention that is not illustrated, the radio receiver 202 components can be omitted. Rather, interactive radio device 106 can be configured as solely a feedback device having a feedback generation module, user input mechanisms, and a backchannel transmitter. Such a device can receive control data from an audio source and/or data source by wires or wirelessly or depend upon a listener hearing content from a separate radio device. This device is advantageous in that it can be widely compatible and with different forms of radio but still allow a user to provide quick feedback even if they do not have the appropriate receiver.

Figure 3:
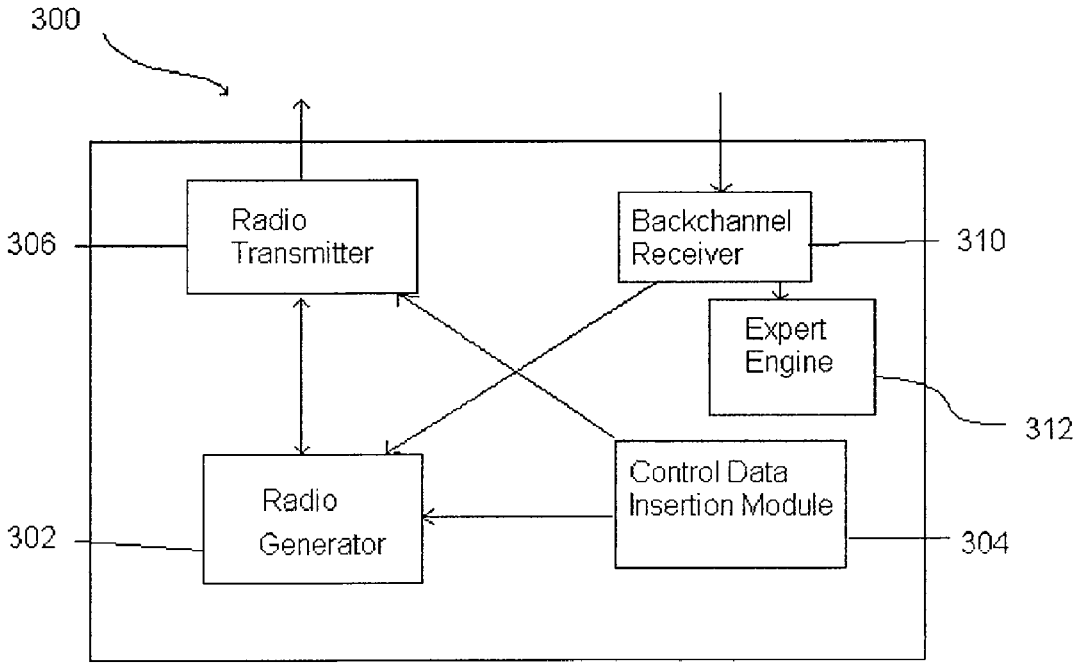
FIG. 3 illustrates a system for transmitting audio content from an interactive radio device and receiving feedback over a backchannel from an interactive radio device according to yet another example embodiment of the invention.

Referring now to FIG. 3, a preferred backchannel enabled radio broadcast system 300 is depicted generally in block form. Most component and modules necessary to operate such a system are well known in the art and are not be discussed or illustrated herein to avoid obscuring the invention. Generally, however, radio broadcast system 300 includes a radio signal generating system or module 302. Audio content such as radio or voice is processed through radio module 302.

In one embodiment, before or as audio is output from module 302, data or code is added to the audio stream in control data insertion module 304. This enhanced radio signal is transmitted by transmission module 306 and contains the code and data necessary to direct an interactive radio device 106 to request direct data input from a listener or indirectly monitor the listener's activities to obtain desired information about the listener's listening activities and characteristics.

Radio broadcast system 300 also includes a feedback portion that includes a backchannel receiver 310 and an expert analysis module 312. The feedback portion, including the backchannel receiver 310 and the expert analysis module 312 can be part of a contiguous device with the other depicted portions of the radio broadcast system 300, but can also be separately housed and operated. Backchannel receiver 310 is configured to receive the feedback data from interactive radio device 106 over the backchannel. The backchannel can at least partially include existing infrastructure that may include networks such as WiFi networks, cellular networks, Bluetooth networks, and other communications systems or computer networks. The backchannel may also include use of the Internet, other computer networks, or a direct link.

An expert analysis module 312 or other data compiler is used to receive the user feedback and optionally compile and/or analyze the user feedback so it can be most effectively reviewed by a producer, talk show host, DJ, or other administrator. As an example of the analysis that can be performed, the expert analysis module 312 can compare the times that users change radio stations to the content broadcast on the stations at those times. The expert analysis module 312 could then determine useful information such as when users tune in to traffic or news on a given station and what songs trigger a given listener to change the station. By analyzing patterns, more advanced analysis systems can break down the information to distinguish between channel changes influenced by content from channel changes influenced by a predetermined desire to review scheduled content on another station. For example, it has been determined there is a higher likelihood that a channel change in the first fifteen second of a song is a strong indicator that the song is disliked by a given listener.

In one example implementation of the invention, a radio broadcaster broadcasting a talk radio program can obtain real time broad based listener interaction. In one embodiment, this can be accomplished with built-in user input features on their interactive radio device. The built-in user input mechanisms 204 allow a user to input data that is quickly transmitted to a radio broadcaster. Such user input mechanisms are not limited by the invention and can include a touch pad, a switch, buttons, a joystick, a mouse, a keyboard, voice control, or any other current or future developed user input mechanisms.

Accordingly, in one example implementation a talk show radio host at system 302 can ask listeners a poll question, for example which of three political candidates they prefer, and the listening user can input data indicative of their selection. The input data can be nearly instantaneously transmitted to the radio broadcaster and the compiled data given to the radio talk show host so his or her comments can be directed accordingly. In another example a DJ can implement a real time "battle of the bands" where listeners vote for favorite music bands based on recently played songs. From the foregoing, it is readily seen that the content or type of listener response that can be requested by a talk show host or DJ is limited only by the media broadcaster's creativity. In one embodiment of the invention, an incentive system may be implemented to encourage users to input data indicative of their selection. For instance, where a user pays a subscription fee (such as for satellite radio), reduction of the subscription fee can be offered as an incentive to the user for providing user input responding to a query.

Figure 4:
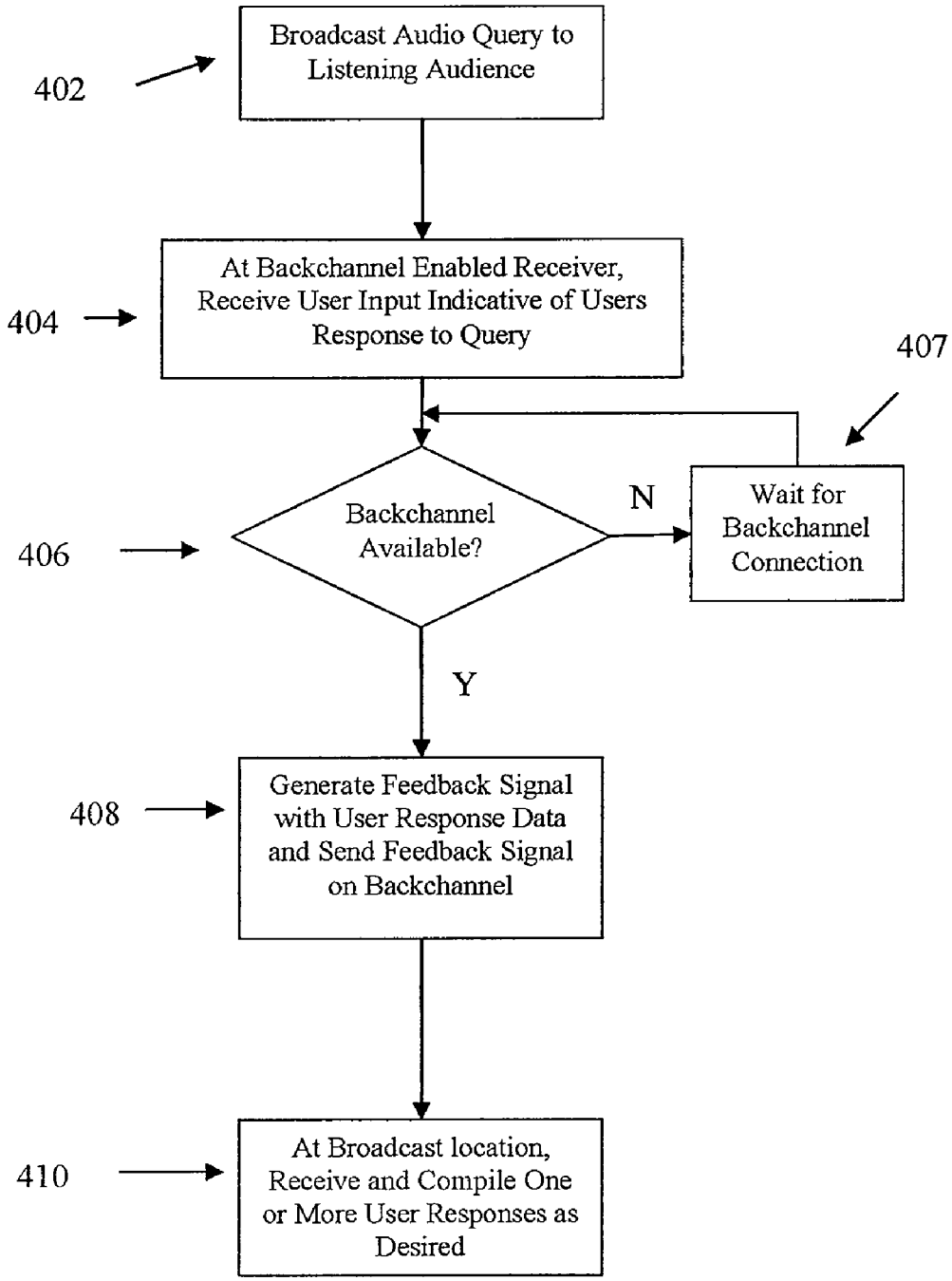
FIG. 4 illustrates, in block form, a method for a radio listener to provide feedback to a radio broadcaster over a backchannel according to a further example embodiment of the invention.

Accordingly, FIG. 4 illustrates an example method of obtaining listener feedback based upon user input devices present in a backchannel receiver. As illustrated in block 402, a radio host such as a DJ, talk show host, advertiser, or other audio source broadcasts an audio query to the listening audience. This query preferably takes the form of a request for a user to provide some form or response over a backchannel. For example, this query can entail asking a listener to select a preferred song, respond to a poll question, rate a particular news event, object, person or performance on a scale, etc.

When the audio query is heard by a listener having a backchannel enabled receiver, the user can input their response on the user input controls of the device. As previously mentioned, an incentive may be offered to encourage the user to provide a response to the audio query. The user input data is received, as indicated by block 404, and prepared to be sent to a data collection locale such as the initial broadcast location. The methods of the invention determine if a backchannel is currently available, as indicated by block 406. If a backchannel is not available, as indicated by block 407, then the feedback data is stored while the device waits for a backchannel to become available, as indicated by block 410. When the backchannel is available, a feedback signal with the user response data is sent on the backchannel to the indicated destination, as indicated by block 408. It is also optional that data is simply stored and transmitted at a later time even though a backchannel is available. At the indicated location for receipt of the user response data, for example the broadcast location, all user responses are collected and compiled, analyzed, and/or presented to an administrator such as a producer, talk show host, or DJ, as desired, as indicated by block 410. In another embodiment, the user responses are sent to a server computer that analyzes the data and forwards the results for use at the broadcast location.

Figure 5:
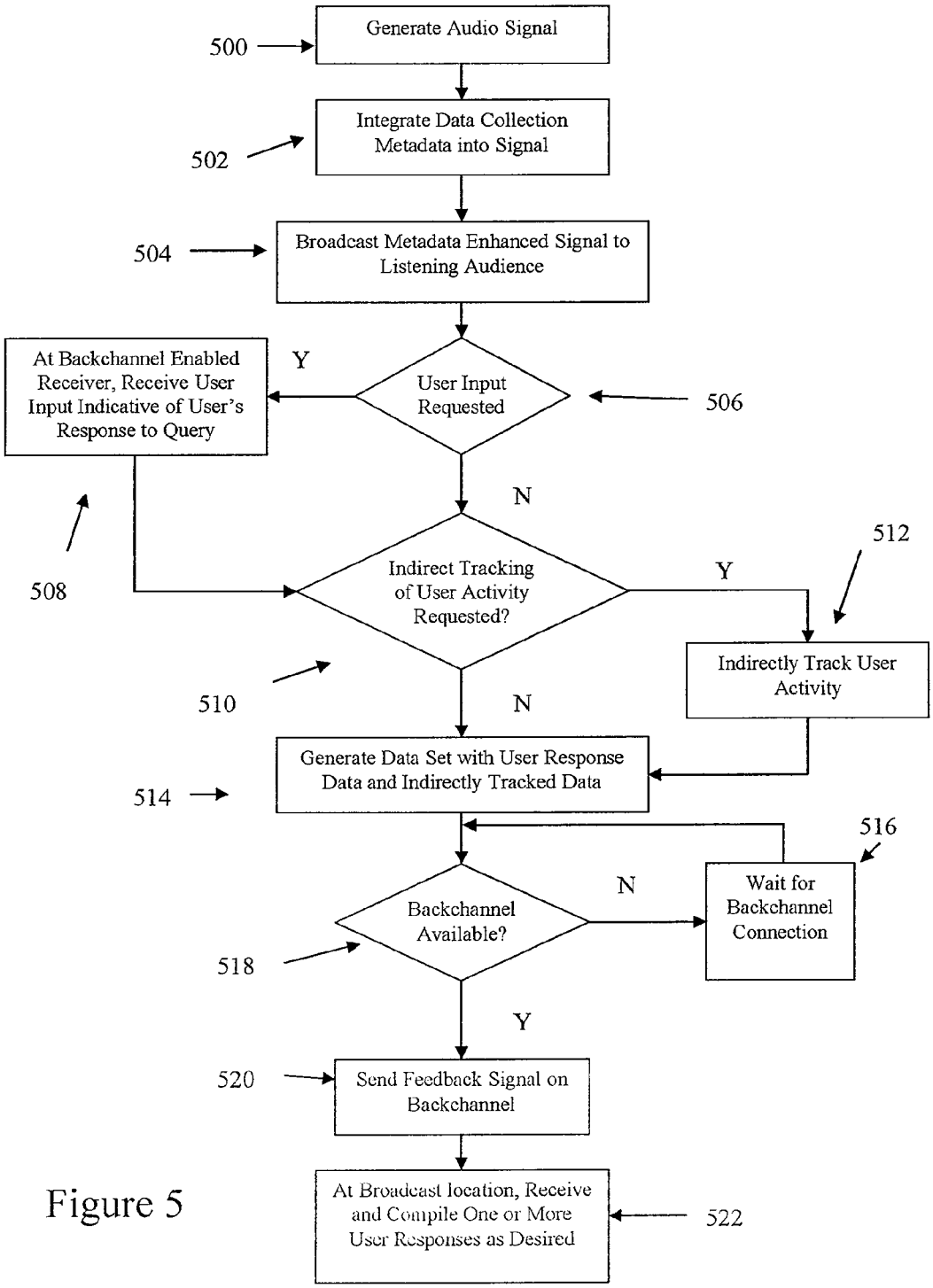
FIG. 5 illustrates, in block form, a method for a radio listener to provide feedback to a radio broadcaster over a backchannel according to another example embodiment of the invention.

In another example method of the invention, depicted in block form in FIG. 5, after or while an audio signal is generated, data or code is integrated with or coupled to the audio signal such that an enhanced radio signal is received by the listening audience, as indicated by blocks 500, 502, and 504. Accordingly, this embodiment of the invention includes broadcast systems that can enhance a radio signal or detect an enhanced radio signal as described herein. The signal is received by end user devices.

The methods and systems of the invention determine if the data enhanced audio signal is designed to collect direct data and therefore requires user input, as indicated by block 506. If so, at an interactive radio device, a user is prompted by the interactive radio device to input data. In various embodiments, this data can be input either in response to a cue directed by the data enhanced audio signal or by an audio cue in the audio signal. Regardless, the interactive radio device receives from a user data indicative of the user's input, as indicated by block 508.

Next, as indicated by block 510, the systems and methods of the invention review whether the indirect tracking of user activity will be performed. By "indirect tracking of user activity," it is meant that a listener is not actively aware of the data that is being collected, although the user may be generally aware of what data is being collected. By way of example only, indirect tracking of user activity can include the timing of station changes, including what content is playing during a station change, what stations are listened to at what times, content of digital audio files stored on the receiver in the event the receiver is a multi function device, GPS location data, advertisements listened to, advertisements that trigger a user response such as visiting a Web site or printing a coupon, and other data as desired. While a user can be aware of indirect tracking of data, it is not necessary for a user to perform any specific action for the data to be recorded or transmitted. User activity may be indirectly tracked as indicated by block 512.

After user activity is indirectly and/or directly tracked, a data set containing the information is prepared, as indicated by block 514. After a query to determine whether a backchannel is available, the device waits for the backchannel to become available, if necessary as indicated by block 516. It is also optional that data is simply stored and transmitted at a later time even though a backchannel is available. As indicated by block 520, the feedback signal (including the data set) is sent once the data set and backchannel are ready. At the indicated location for receipt of the user response data, for example the broadcast location, all user responses are collected and compiled, analyzed, and/or presented to an administrator such as a producer, talk show host, or DJ, as desired, as indicated by block 522.

In another embodiment, the method may begin at block 510 by indirectly tracking user activity. In this case, it may not be necessary to receive enhanced content in order to obtain user information.

Those skilled in the art will appreciate that various of the foregoing features of the invention may be practiced alone or in network environments with many types of computer system configurations, including media players, satellite radio receivers, FM transmitters or receivers, DAB transmitters or receivers, personal computers, hand-held devices, multi-processor systems, microprocessor-based or programmable consumer electronics, network PCs, minicomputers, mainframe computers, and the like. Aspects of the invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

Embodiments of the interactive radio device 106 and the broadcast station 102 may include computer-readable media for carrying or having computer-executable instructions or data structures stored thereon. Such computer-readable media can be any available media that can be accessed by a portable device or general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a portable device or general purpose or special purpose computer. When information is transferred or provided over a network or another communications connection (either hardwired, wireless, or a combination of hardwired or wireless) to a computer, the computer properly views the connection as a computer-readable medium. Thus, any such connection is properly termed a computer-readable medium. Combinations of the above should also be included within the scope of computer-readable media. Computer-executable instructions comprise, for example, instructions and data which cause a general purpose computer, special purpose computer, or special purpose processing device to perform a certain function or group of functions.

Although not required, the invention may be described in the general context of computer-executable instructions, such as program modules, being executed by computers in network environments. Generally, program modules include acts, routines, programs, objects, components, data structures, etc., that perform particular tasks or implement particular abstract data types. Computer-executable instructions, associated data structures, and program modules represent examples of the program code means for executing acts of the methods disclosed herein. The particular sequence of such executable instructions or associated data structures represents examples of corresponding acts for implementing the functions described in such acts.

The devices may also include a magnetic hard disk drive for reading from and writing to a magnetic hard disk, a magnetic disk drive for reading from or writing to a removable magnetic disk, or an optical disk drive for reading from or writing to removable optical disk such as a CD-ROM or other optical media. The drives and their associated computer-readable media provide nonvolatile storage of computer-executable instructions, data structures, program modules and other data. Although the example environment described herein may employ a magnetic hard disk, a removable magnetic disk and/or a removable optical disk, other types of computer readable media for storing data can be used, including magnetic cassettes, flash memory cards, digital versatile disks, Bernoulli cartridges, RAMs, ROMs, and the like.

Program code means comprising one or more program modules may be stored on the hard disk, magnetic disk, optical disk, ROM or RAM, including an operating system, one or more application programs, other program modules, and program data. A user may enter commands and information through a keyboard, pointing device, or other input devices (not shown), such as a microphone, joy stick, touch pad, game pad, satellite dish, scanner, or the like. These and other input devices are often connected to the processing unit through a universal serial bus (USB) or serial port interface coupled to system bus. Alternatively, the input devices may be connected by other interfaces, such as a parallel port, or a game port. A display device is also connected to system bus via an interface, such as video adapter.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An interactive radio device operable to provide feedback to an audio provider, comprising:

a radio receiver operable to receive and play to a user an audio stream and to receive an enhanced radio signal that includes control data that instructs the interactive radio device on how to collect feedback data;

a feedback generation module operable to generate feedback data indicative of one or more of: a user's input, listening activities, or other activities related to the content of the audio stream; and a backchannel transmitter operable to transmit the generated data to a data collector over a backchannel.

2. A device as defined in claim 1, wherein the radio receiver comprises a satellite radio receiver, a DAB receiver, an FM receiver, and AM receiver, or a Web based audio receiver.

3. A device as defined in claim 1, wherein the backchannel transmitter transmits its signal using a computer network including at least the Internet.

4. A device as defined in claim 1, wherein the backchannel transmitter transmits its signal by a wireless connection comprising an 802.11 system, a local FM signal, or Bluetooth.

5. A device as defined in claim 1, further comprising a location identification device operable to identify the location of the radio receiver and wherein the generated data includes the location of the radio receiver.

6. A device as defined in claim 1, further comprising a user input mechanism such that the generated data includes data input by a user absent a system generated query to the user.

7. A device as defined in claim 1, wherein the device is configured to communicate a query to a user in response to control data received with the audio stream.

8. A device as defined in claim 7, wherein the device further comprises a user input mechanism such that the generated data can include data input by a user in response to the query.

9. A system for obtaining feedback from a user listening to an audio broadcast, the system comprising:

a radio broadcast system operable to generate a radio signal and transmit it to a plurality of users using interactive radio devices;

a control data insertion module for embedding control data in the radio signal, wherein the control data instructs the interactive radio devices on how to collect feedback data; and a backchannel receiver configured to receive feedback data from an interactive radio device, wherein the feedback data can be received by the backchannel receiver through a backchannel between the interactive radio device and the backchannel receiver.

10. A system as defined in claim 9, wherein an incentive is offered to users to encourage the users to provide feedback data to the system.

11. A system as defined in claim 9, whereby an interactive radio device configured to detect the control data can be triggered to gather data and send the data to the system on the backchannel.

12. A system as defined in claim 9, wherein the radio broadcast system comprises: satellite radio, Internet radio, DAB radio, HD Radio, AM radio or FM radio.

13. A system as defined in claim 9, wherein the backchannel comprises an 802.11 network, or an Internet connection.

14. A system as defined in claim 9, further comprising an expert engine configured to analyze indirect data to determine user preferences and listening patterns, the indirect data including data obtained by indirectly tracking user activity.

15. A system as defined in claim 9, further comprising an expert engine configured to analyze direct data to determine user preferences and listening patterns, the direct data including data obtained in response to system-generated requests for user input.

16. A system for obtaining feedback from a user listening to an audio broadcast, the system comprising:

an interactive radio broadcast system, comprising:

an audio broadcast system operable to generate an audio signal and transmit it to a plurality of users as an audio broadcast;

a control data insertion module for embedding control data in the audio broadcast, wherein the control data instructs a radio receiver on how to collect feedback data, whereby a radio receiver configured to detect the control data can be triggered to gather data and send the data to a data collector over the backchannel; and the data collector, comprising an interactive radio device wherein the data can be received by the data collector through a backchannel between the radio receiver and the interactive radio broadcast system; and at least one interactive radio device operable to provide feedback to an audio provider, the device comprising:

a radio receiver operable to receive and play to a user the audio broadcast;

a user input mechanism configured to enable a user to input data regarding or in response to the audio broadcast;

a feedback generation module operable to generate data indicative of a user's input, listening activities, or other activities related to content in the audio data stream; and a backchannel transmitter operable to transmit the generated data to the data collector.

17. A system as defined in claim 16, wherein the audio broadcast system comprises satellite radio, Internet radio, DAB radio, HD radio, AM radio, or FM radio.

18. A system as defined in claim 16, wherein the backchannel comprises one or more of an 802.11 network or an Internet connection.

19. A system as defined in claim 16, further comprising an expert engine configured to analyze indirect data to determine user preferences and listening patterns, the indirect data including data obtained by indirectly tracking user activity.

20. A system as defined in claim 16, further comprising an expert engine configured to analyze direct data to determine user preferences and listening patterns, the direct data including data obtained in response to system-generated requests for user input.

21. A system as defined in claim 16, further comprising a plurality of interactive radio devices operable to provide feedback to an audio provider.

22. In an interactive radio device, a method of obtaining feedback from a user, the method comprising:

receiving a signal from an interactive radio broadcast system, wherein the signal received from the interactive radio broadcast system comprises an enhanced signal, the enhanced signal including an audio signal and control data integrated with the audio signal, wherein the control data instructs the interactive radio device on how to collect feedback data;

tracking data indicative of user activity related to the content of the signal;

generating a data set including the tracked data; and transmitting the generated data set over a backchannel to the radio broadcast system.

23. The method of claim 22, wherein the step of tracking data indicative of user activity is performed in response to receiving the control data of the enhanced signal.

24. The method of claim 22, wherein the control data includes one or more of: metadata, a uniform resource locator, and other code that functions to direct the interactive radio device to track data indicative of user activity.

25. The method of claim 22, further comprising, prior to transmitting the generated data set over a backchannel, determining that the backchannel is available.

26. The method of claim 22, where the data indicative of user activity includes indirect data obtained by indirectly tracking user listening activities and direct data obtained in response to requests for user input.

* * * * *